United States Patent [19]

Zhukov et al.

[11] Patent Number: 5,029,675

[45] Date of Patent: Jul. 9, 1991

[54] METHOD AND DEVICE FOR SPEED CONTROL OF RAILWAY TRANSPORT FACILITIES

[76] Inventors: Vasily P. Zhukov, pereulok Krepostnoi, 87, kv. 121; Vladimir I. Ignatkin, ulitsa Pogodina, 5/2, kv. 60; Valery N. Fomishin, ulitsa Borko, 4, kv. 56, all of Rostov-na-Donu, U.S.S.R.

[21] Appl. No.: 523,275

[22] Filed: May 14, 1990

Related U.S. Application Data

[63] Continuation of Ser. No. 350,504, May 11, 1989, abandoned, and Ser. No. 124,779, Aug. 25, 1987, abandoned.

[51] Int. Cl.[5] ..... B61K 7/02; B61K 7/08; B61J 3/06

[52] U.S. Cl. ..... 188/62; 104/249

[58] Field of Search ..... 104/249, 176, 170, 169, 104/166, 162; 198/718; 188/59, 76, 62

[56] References Cited

U.S. PATENT DOCUMENTS

| | | | |
|---|---|---|---|
| 2,104,607 | 1/1938 | Bone | 188/62 |
| 3,295,636 | 1/1967 | Adams | 188/76 X |
| 3,609,350 | 9/1971 | Wilson et al. | 246/182 A |
| 3,861,316 | 1/1975 | Yamazaki et al. | 104/26.2 |
| 4,473,136 | 9/1984 | Emilsson et al. | 188/59 |
| 4,679,665 | 7/1987 | Smith | 188/59 X |
| 4,867,279 | 9/1989 | Link et al. | 188/62 |

FOREIGN PATENT DOCUMENTS

| | | | |
|---|---|---|---|
| 676828 | 12/1963 | Canada | 188/59 |
| 1530302 | 1/1971 | Fed. Rep. of Germany . | |
| 2204954 | 8/1973 | Fed. Rep. of Germany | 104/252 |
| 1092253 | 4/1955 | France . | |
| 1518092 | 2/1968 | France . | |
| 1601306 | 9/1970 | France . | |
| 759370 | 8/1978 | U.S.S.R. | 104/249 |
| 1235645 | 6/1971 | United Kingdom | 188/59 |

OTHER PUBLICATIONS

Zheleznye Dorogi Mira/World's Railways Magazine, 1981, No. 9, pp. 17, 18, and 27.

*Primary Examiner*—Andres Kashnikow
*Attorney, Agent, or Firm*—Lilling and Lilling

[57] ABSTRACT

A method for speed control of railway transport facilities and a device to accomplish the method are used for deceleration and acceleration of transport vehicles in shunting yards. In the process of speed control a pressure element is introduced into an annular space cavity in a wheel, which cavity is formed by the disk hub and inner circular surface in the wheel rim, and is located on the inner or outer side of the wheel, said pressure element applies force action to any point located within one of the two inner circular wheel rim surface regions, located at both sides of an imaginary plane "a-a", passing through the axle of the wheel and through the wheel-to-rail contact point B. The pressure element has a shape designed to provide free entrance of the element into said annular cavity, which pressure element is mounted on a carriage, the carriage being movable along the track. The value of the pressure element force in this solution will not be limited to the weight of a wagon.

5 Claims, 4 Drawing Sheets

METHOD AND DEVICE FOR SPEED CONTROL OF RAILWAY TRANSPORT FACILITIES

This is a continuation of copending applications Ser. No. 07/350,504 filed on May 11, 1989 and Ser. No. 07/124,779 filed Aug. 25, 1987 and now abandoned.

International Application PCT/SU/85/00099 designated the U.S.

BACKGROUND OF THE INVENTION

1. Field of the Invention

The present invention relates to railway transport facilities, and more particularly, to a method of their speed control and to a device for effecting same.

2. Description of the Prior Art

To ensure optimal operation of a shunting yard (or a hump) it is necessary to be able to provide efficient control of the motion speed of said railway transport facilities (of wagons, open wagons, flat wagons, tank wagons etc.), as, for example, to decelerate, accelerate, stop or set in motion stationary transport vehicles.

Numerous methods and means known in the art are presently used to provide speed control of railway transport vehicles.

There is a well known method which is capable to provide deceleration of a railway transport vehicle by way of jamming its wheels between two beams accomodated along a rail, at both sides thereof.

In the described method, however, the actual speeds of transport vehicles, set in motion after being released from delay mechanisms, differ greatly. This phenomenon is due to the fact that the friction coefficient between the surfaces at the "wheel lateral faces/beam faces" is highly unstable because of lubricants, paint, sand, moisture, etc. getting onto said surfaces, as well as due to temperature changes and other factors. Moreover, this method cannot, in principle, be used for speeding up transport vehicles. Therefore, other methods and devices, to be used in shunting yards and to provide speed control (deceleration and acceleration) of transport vehicles, should be capable of employing force interaction present between one, at least, pressure element and a wheel of a transport vehicle, said interaction to be accomplished in the region of mechanical trajectory (motion path) of said wheel. (See, e.g. "Zheleznye Dorogi Mira" /World's Railways/ magazine, 1981, No. 9, pp. 17–18, 27.)

The essence of the above-mentioned method for speed control of railway transport facilities consists in that within the railway track section, chosen as a location for the above control to be effected, the lower flange regions of the outer wheel rim surfaces (being rear, as relative to the train set movement during acceleration, or front, in case of deceleration) are adapted to effect force action by their pressure elements (by rollers, rods, screw faces of conveyors), said elements being located on the way of wheel's motion, in other words, they should be placed ahead of a wheel or behind it. (See, for example, FRG Patent No. 1530302, Int. Cl.$^3$ B61 j3/06).

This method is advantageous in view of the fact that during its realization the force action produced by the pressure element is practically independent of the friction coefficient, and the value of said force effect can be precisely proportioned. This method is taken as a prototype.

It should be noted, however, that the force value acting on the wheel, in accordance with said method, has a strictly limited range which is dependent on the transport vehicle force component applied to the wheel concerned. If this range is exceeded, the result may be running of the wheel over the adjacent pressure element or derailment of the transport vehicle.

This happens to be an essential limitation of the above mentioned method since, for trouble-free operation of the system, the acting force value should correspond to the value of its vertical component. This vertical component should not exceed 17 kN, so as to include the possibility of interaction with "light axles" (i.e. with unloaded wagons) which sometimes makes it difficult, or even impossible, to deal with train sets composed of only a few (8 to 10) wagons.

A device, realizing the described method, is made as a carriage used for displacing railway wagons and other vehicles of rolling stock. Said device comprises two pairs of pressure rollers, capable of extending and retracting transversely to the railway line direction.

One of said pairs, while performing said extending or retracting motion, is disposed some distance ahead of the wheel, while the other is disposed the same distance behind the wheel, and both of them are found in the region of the wheel's motion path.

The pressure rollers can act upon the lower rear and upon the lower front part of the wheel flange, said area acted upon equalling one fourth of said flange. The device itself moves along additional rails laid parallel the existing railway lane and inside thereof, and said device being set in motion by a cable connected to a drive unit.

When a wagon, with its sheels between the extendable rollers, moves faster than said carriage does, the wheel flange starts pressing-down on the roller located ahead of the wheel. The potential energy accumulated by the wagon will become transmitted to the carriage via the roller, and further through the cable to the drive unit, which will absorb said energy. Accordingly, the wagon speed will be slowed down to that of the carriage.

If a wagon, with its wheels between the extendable rollers, moves slower than the carriage does, the pressure roller being located behind the wheel starts pressing down on the flange corresponding to the rear lower fourth of the wheel. In addition, the energy from the drive unit will be delivered to the wheel via the lower roller, carriage and cable, thus increasing the wagon speed to the level equalling the carriage speed.

The above-mentioned interaction between the pressure rollers and the wheel flange (both during deceleration and acceleration) is accompanied, however, with the emergence of a force component directed vertically upward. It is therefore required to impose a strict limitation on the force magnitude of such an interaction, since in cases when said vertical component exceeds the value of weight force applied to the corresponding wheel axle, one can expect separation of the wheel from the rail head with a possibility of subsequent derailment of the wagon. Thus, the possibility of raising the efficiency of such controlling actions is sufficiently diminished.

SUMMARY OF THE INVENTION

The main object of the present invention is to provide a method and a device for speed control of railway transport facilities, in which the interaction between a pressure element and a wheel is accomplished in a manner which would allow the permissible acting force value, applied by the pressure element to the wheel, not to be limited by the wagon weight delivered to the corresponding wheel, which method would additionally make it possible to eliminate entirely any possibility of derailment of the wagon, at any level of said interaction force, ensuring simultaneously a preset accuracy of speed control.

Said object is accomplished due to the fact, that in a method for speed control of railway transport facilities, effected by way of force interaction between at least one pressure element and a wheel of a transport facility, accomplished within the region of the wheel motion path, said pressure element, in accordance with the invention, is introduced, from the inner or outer side of the wheel, into an annular space cavity formed by the disk, the hub and the inner radial rim surface of the wheel, and the effected force, depending on its direction, is applied to any point placed at one of the two inner circular wheel rim surface regions located at both sides of an imaginary plane passing through the wheel axle and the point of the wheel's contact with the rail. Accordingly, the length of said two regions, formed by the inner circular wheel rim surfaces, can correspond to their arc lengths, restricted by the rays drawn from the centre of the wheel and spaced apart from the wheel-to-rail-contact point through an angle of 2° and 145°. In the most preferable embodiment the extension of said inner radial wheel rim surface regions correspond to their arc length defined by the rays drawn from the wheel centre and spaced apart from the wheel-to-rail contact point through angles of 2 and 90 degrees.

In a device employed to accomplish the proposed method and comprising at least one pressure element participating in force interaction with a wheel, within said wheel motion path region, which element is mounted on a carriage element capable of moving along the rail line and connected to a drive power unit, and to a means to control said pressure element position, in accordance with the invention, said pressure element being mounted on said carriage, can be introduced, from the inner or outer side of the wheel, into an annular space cavity, formed by the disk, hub and inner circular wheel rim surface of the wheel, which cavity is adapted to have a shape chosen to provide a free entrance of said pressure element into said cavity and to ensure the required fit of said pressure element to the inner circular wheel rim surface, at any point of one of the two regions, located at both sides of an imaginary plane, passing through the center of said wheel and the wheel-to-rail contact point.

The length of both regions, formed by said inner circular wheel rim surface can correspond to the arc length thereof, defined by the rays, drawn from the wheel centre and spaced apart from said wheel-to-rail contact point through an angle of 2° and 145°, said angle equalling, in the preferred embodiment, 2° to 90°.

The bearing elements of the carriage unit would be suitable to place between the head and foot of a running rail, with the pressure contact applied either to the head of the rail or to the foot thereof. Besides, the carriage unit itself may be adapted to be able to move in a vertical direction.

The introduction of the pressure element into the interior of the above-mentioned annular space cavity and its pressure effected on any point within one of said two regions, formed by the inner circular wheel rim surface, makes it possible to accomplish such a pressure action on the wheel, that would not be limited by the value of weight force to be applied to said wheel, since this move of force application would never include a vertically directed force component, which would be particularly so in the range of 2° to 90° measured from the wheel-to-rail contact point. In other words, any force value, applied by the pressure element, would never effect separation of the wheel from the wheel head. Moreover, any force, applied at angles less than 90°, would press the wheel to the rail. This is undoubtedly the principal advantage of the proposed method, since it provides a hazard-free application of force to a wheel of a transport vehicle (independent of weight value, applied to said wheel), which method can practically ensure any mode of motion to be controlled, that is to ensure an efficient deceleration and acceleration, setting in motion a wagon, which has come to a stop, fixing of wagons on the railway track etc., all of which can be accomplished avoiding any risk of derailment of the vehicles. With the employment of said method all the increased force actions to be accepted by the wheel, are absorbed with an excessive safety margin. Thus is due to the fact that speed control of the railborne transport facilities, being usually effected in shunting yards, during rolling down such vehicles from humps and in the course of other shunting operations, is performed with said vehicles moving, as a rule, at exceedingly low speeds (0 to 35 km/h). In this respect, it is well known, that permissible static loads applied to the wheels are considerably lower than dynamic loads. The dynamic loads, at speeds equalling 120 to 160 km/h, are several times higher than the maximum permissible static loads. Accordingly, there is a considerable safety margin in case of handling vehicles moving with a speed in the range 30 to 40 km/h.

Besides, it should be borne in mind, that with this method, the value of force action would practically be limited, in every case, by the permissible acceleration only, which can be applied to the wagon without any hazard leading to damage of the vehicle or the goods contained therein.

Moreover, it should also be noted, that when the pressure element acts upon a point located within the lower semicircle of the inner wheel rim surface, said point lying in an imaginary plane passing through the wheel axle and the wheel-to-rail contact point, one would never get the desired effect, since the force applied to the above-mentioned point would not include the horizontal force component, which is the only one to produce the required control effect (an increase in the resistance forces opposed to the rolling of the wheel in this case are not taken into account). It should be added, in this respect, that the value of the horizontal force component in the region of 2°, as measured from the wheel-to-rail contact point, is negligibly small.

Furthermore, it should also be taken into consideration, that when the acting force is applied within the inner rim surface region located above the wheel axle, the acting force would form its vertical component which would tend to separate the wheel from the rail. Therefore, the application of forcing action, within the inner circular wheel rim surface, to points located above 145°, as measured from the wheel-to-rail contact point, would be not to the purpose.

Besides, in contrast to the method and device taken as the prototype, in which the interacting surfaces (the inner circular wheel rim surface—the wheel flange the pressure roller) have different signs of curvatures, the present invention makes use of a pressure roller which has shape chosen to fit said inner wheel rim surface, said shape having the same curvature sign with said inner circular surface (thus providing a more optimal mating of the interacting surfaces) and ultimately results, with all the other factors being equal, in considerably lower contact stresses, thus ensuring less wear and increased life of the device.

The dimensions of the pressure roller to be introduced into the above-mentioned circular space cavity should provide a proper fit of said elements, allowing for the tolerances of the initial dimensions of the wheel, for the wear of the wheel and rail and for other parameters in connection with the specific design configuration.

In the present device, for acceptance of all the loads, acting upon the carriage element in a vertical direction, as well as in a horizontal direction, transverse to the railway line running rails are used only, since the bearing elements of the carriage unit are adapted to be accommodated between the head and foot of a running rail. It should be noted in this respect, that when the vertically applied load reaches its maximum value, the force flux is closed along the shortest route, which includes the pressure element, the wheel, the upper rail, head surface, the lower- rail head surface, the bearing element, this being accomplished by using the carriage movable in the vertical direction. The described engineering solution would lead to a substantial decrease of material consumption used to fabricate the whole structure.

BRIEF DESCRIPTION OF DRAWINGS

The invention will become more readily apparent from the following description of the method for speed control of railway transport facilities and the device for effecting same, with reference to the accompanying drawings, wherein.

DESCRIPTION OF THE PREFERRED EMBODIMENTS

Figure 1:
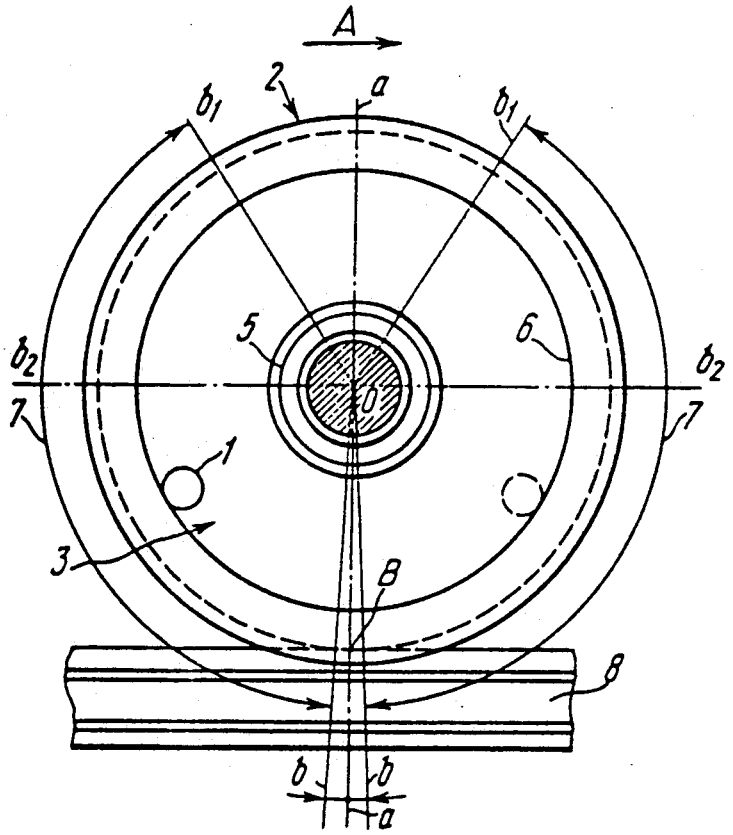
FIG. 1 is a schematic presentation of a pressure element accommodated in the annular space cavity formed in the wheel; the direction of the wheel's motion is shown by arrow A.
Figures 2A, 2B:
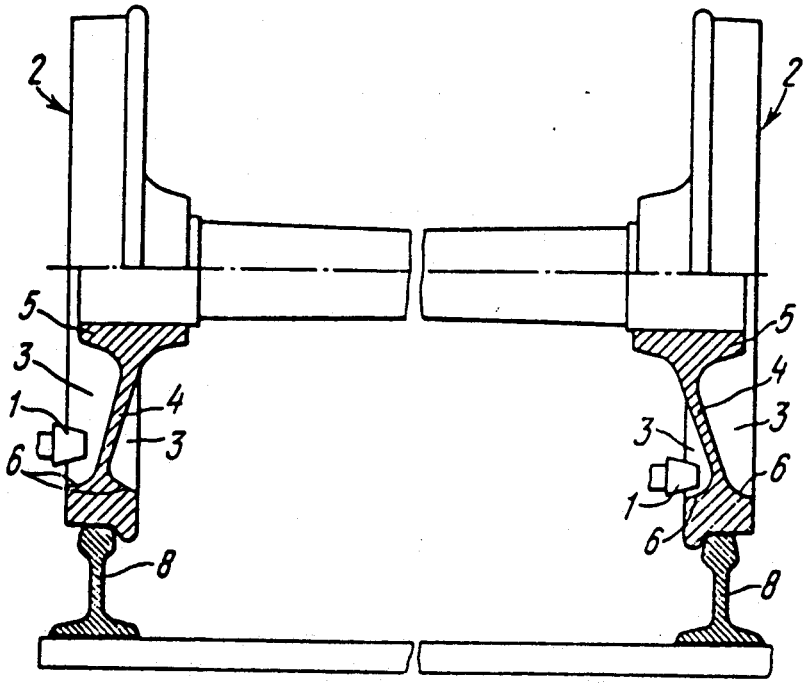
FIG. 2*a* and 2*b* are schematic views illustrating the introduction of pressure elements into the wheel pair from the outer and inner side thereof.

The essence of the proposed method for speed control of railway transport facilities is accomplished in the following manner. At least one pressure element 1 (FIG. 1) is introduced from the outer (FIG. 2*a*) or the inner (FIG. 2*b*) side of a wheel 2 into an annular space cavity 3, formed by disk 4, hub 5 and inner circular surface 6 of wheel rim 2. The pressure element 1, being introduced into said cavity, starts to act, depending on said acting force direction, i.e. braking or acceleration, upon any point, located within one of the two regions 7 (FIG. 1) in the inner circular surface 6 of the wheel rim, said regions being located at both sides of an imaginary plane "a-a", passing through the wheel axis O and the point B of said wheel, contacting with the rail 8.

When the pressure element 1 acts upon the inner circular surface 6 of the wheel rim 2, which surface is positioned close to the above-mentioned plane "a—a", the horizontal vector of said acting force will be rather small, therefore, so as to enhance the efficiency of transport vehicle speed control, each of the regions 7 has a length corresponding to the arc of the inner circular surface 6 of the wheel rim 2, which arc is defined by rays b, b, drawn form the center of the wheel and spaced apart from the point B through an angle of 2° to 145°, at which point B the wheel 2 contacts with the rail 8. When the applied force acts upon the inner circular surface 6 of the wheel rim within the regions 7 defined by rays b, $b_2$, drawn from the wheel centre and spaced from the wheel-to-rail contact point B through an angle of 2° to 90°, the wheel is pressed to the rail by the acting force vertical component, which situation allows the forcing action on the wheel to be effected without limiting said force to the value equalling the weight of the train set, which weight is applied to the wheel to rule out the hazard of derailment of said train set.

At the application of force from the pressure element 1 to the regions 7 of the inner circular surface 6 in the wheel rim 2 said regions being defined by the rays $b_2$, $b_1$ drawn from the wheel centre at an angle 90° to 145°, a vertical component of the acting force arises, which force component tends to separate the wheel from the rail, and its value is limited, accordingly, by the value, equalling the wagon's weight force, applied to the wheel. When the force from the pressure element is applied to the inner circular wheel rim surface 6 at an angle 90° measured from the wheel-to-rail contact point, said applied acting force does not include any vertical component therein, which situation allows the provision of the controlling effect (acceleration-braking) of a maximum value.

During deceleration (braking) the pressure element 1 acts upon the rear region 7 (relative to the direction of the transport vehicle motion), in the inner circular surface 6 of the wheel rim, while during acceleration said pressure element 1 (shown by dotted line) acts upon the front region 7 (relative to the motion direction) in the inner circular wheel rim surface 6.

Figure 3:
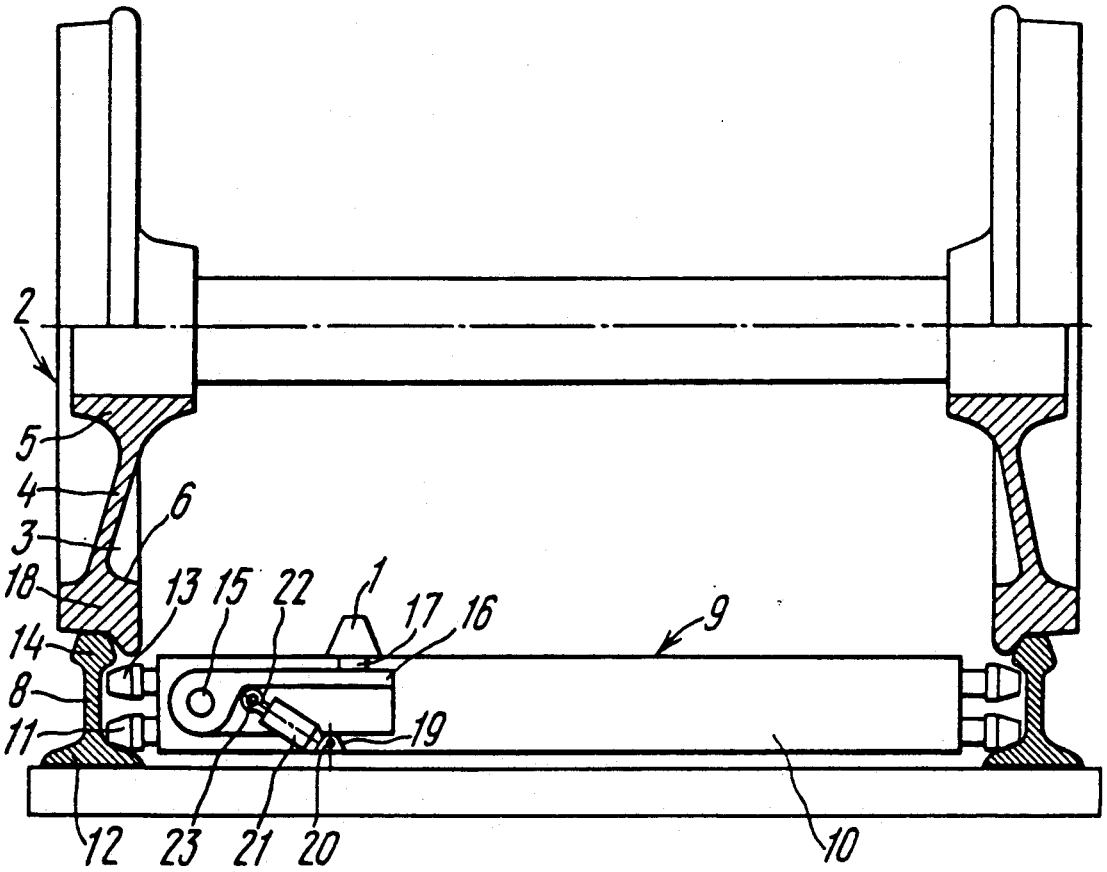
FIG. 3 is a basic configuration of the device for speed control of railway transport facilities, shown as accomodated inside the track, said device being in its initial position.

The device, designed to accomplish the described method, comprises a pressure element 1 (FIG. 3) adapted to effect force interaction with a wheel 2, in the region of mechanical trajectory of said wheel, and a means designed to control the position of said pressure element 1, which means can be of any conventional design well known in the art. The pressure element 1 is mounted on a carriage 9 adapted to be movable along the track and connected to a drive unit. The pressure element 1 mounted on the carriage 9 is capable to enter an annular space cavity 3 formed by the disk 4, hub 5 and the inner circular surface in the rim 6 of the wheel, said cavity having a shape adapted to provide an obstacle-free introduction of said element 1 into said cavity 3, said entrance being effected from the inner side of the wheel 2, and to provide a suitable mating of said element with the inner circular wheel rim surface 6 at any point within one of the two regions 7 (FIG. 1), located at both sides of an imaginary plane "a-a", passing through the axis of the wheel 2 and the point B of the wheel's contact with the rail 8.

Depending on the specific character of the wheel's shape (its rim, disk and hub), as well as on the structure of the engaged track section, it may appear more suitable to introduce the pressure element into said wheel cavity from the outer side of the wheel 2 (FIG. 2*a*) or of the wheel pair. The device, to comply with this requirement, should comprise a carriage, movable along the base of a running rail, and an additional guide positioned beyond the track and capable to accept the force of interaction between the pressure element and the inner circular wheel rim surface being positioned at the outer side of the wheel (or of the wheel pair).

To accomplish said introduction of the pressure element from outside, various suitable devices can be used, in which said pressure element is designed in accordance with the present invention.

Referring now again to FIG. 3, the carriage 9 designed to have dimensions suitable to be accommodated inside the track, is mounted to be vertically movable and adapted to include a frame 10. The frame 10 is provided with four bearing elements made as rollers 11, designed to contact the surfaces of the base 12 in the rail 8, said surfaces facing inside the track, as well as four bearing elements made as rollers 13, designed to contact the lower surfaces of the head 14 in the rail 8, which surfaces also face the inner part of the track.

Mounted on the frame 10 and parallel to the rail 8 is an axle 15, said axle supports an arm 16 turnably mounted thereon and bearing the pressure element 1, made in the shape of a roller. The pressure element 1 is rotatably mounted on said arm 16 by an axle 17. The shape and dimensions of said pressure element 1 are such as to provide a generatrix thereof to ensure coincidence with the outline of the inner circular surface 6 in the rim 18 of the wheel 2, said axle of rotation 17 being parallel, in its working position, to the axle of the wheel pair. In this respect the length of the generatrix of the element 1 is such as to provide the maximal mating area within the region of the contact between said pressure element and the inner surface 6 in the rim 18 of the wheel 2. The dimensions of the arm 16, of the pressure element 1 and of the axle 17 are chosen to provide contact between the working surface of the pressure element 1 and both the front and the rear regions 7 formed in the inner circular surface 6 in the rim 18 of the wheel 2, when the arm 16 is turned to the working position, in which position the pressure element 1 is accommodated in the interior of the cavity 3, formed by the inner circular surface 6 in the rim 18 and by the disk 4 of the wheel 2.

Figure 4:
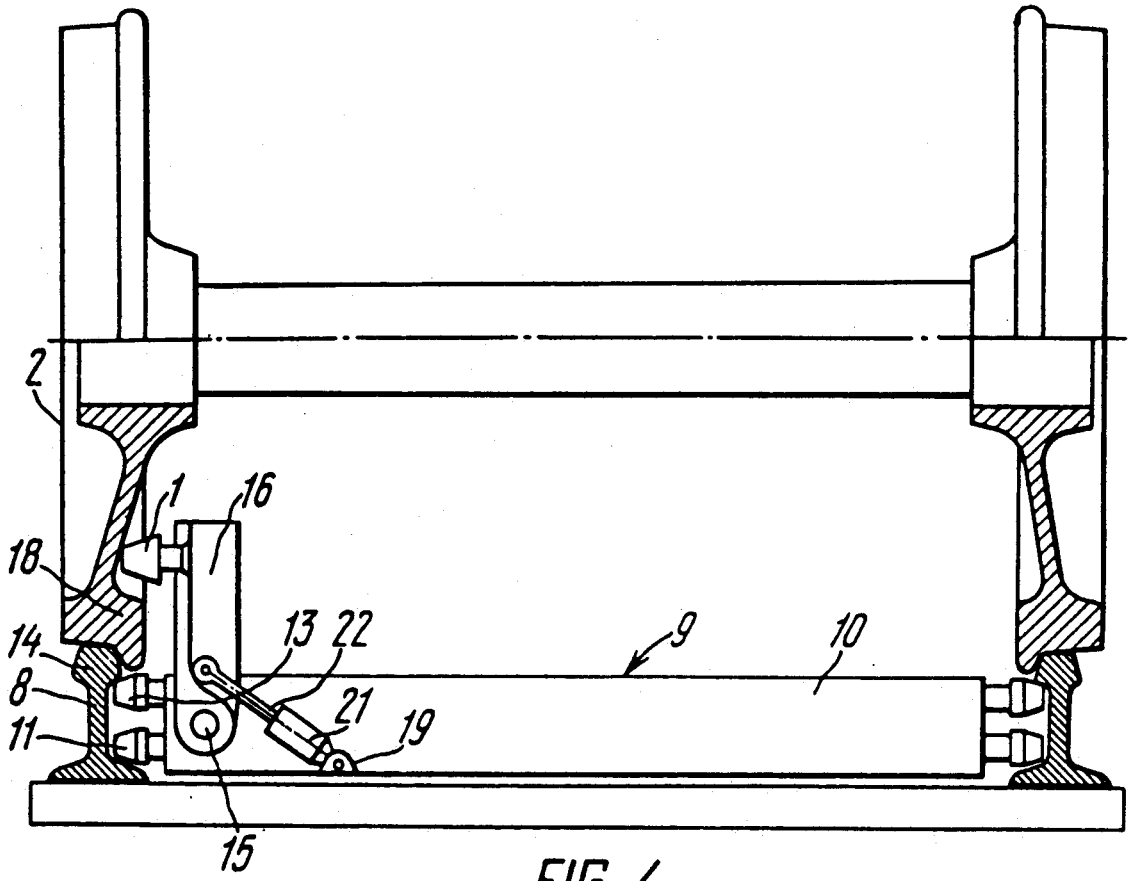
FIG. 4 shows the device according to FIG. 3, said device being illustrated in the working position, with the pressure element introduced in the annular space cavity of the wheel.
Figure 5:
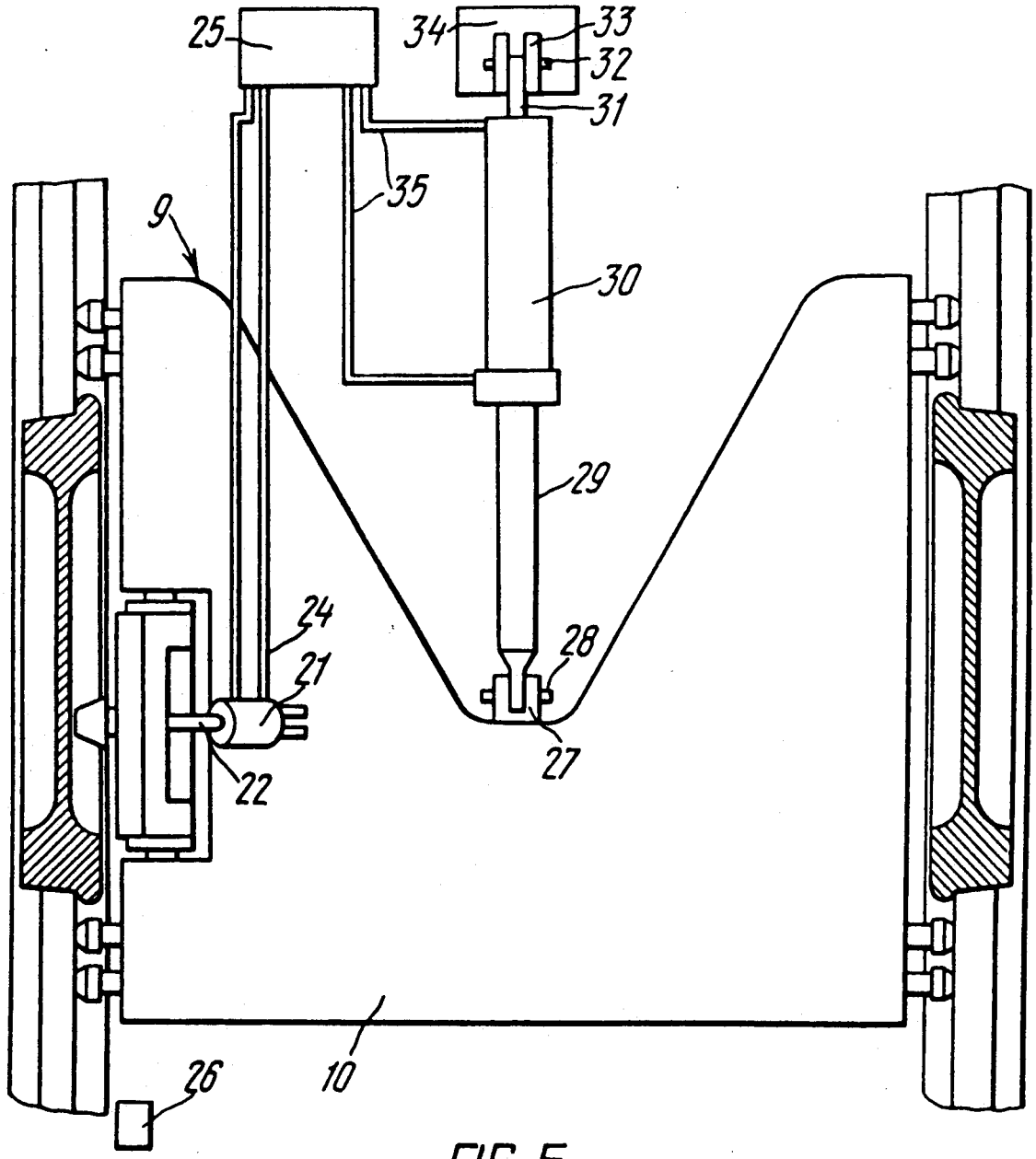
FIG. 5 is a top view of the device according to FIG. 4.

Mounted on the frame 10, by means of an arm 19 and an axle 20, is a hydraulic cylinder 21, and the rod 22 thereof is connected by an axle 23 with the arm 16 and can turn said arm about an axle 15 through a preset angle, as shown in FIG. 4. Both chambers of the hydraulic cylinder 21 are connected by flexible hoses 24 (FIG. 5) with a pumping plant 25.

Sensors 26 are provided to ensure working control over the pumping plant 25 and the cylinder 21, said sensors being set in operation at a certain position of the wheel 2 relative to the supporting frame 10. The sensor 26 can be of any conventional design initable for the purpose said sensor 26 can, in addition, be used to control the position of the pressure element.

Connected to the frame 10, by an arm 27 and an axle 28, is a rod 29 of a drive hydraulic cylinder 30.

An eye 31 of the hydraulic cylinder 30 is connected by an axle 32 with an arm 33, said arm being rigidly fixed to a stationary base plate 34.

Both chambers of the drive hydraulic cylinder 30 communicate with the pumping plant 25 via flexible hoses 35 designed to operate at high pressures. The flow rate of the liquid, its direction and pressure are set by a regulator well known in the art (said regulator is not shown in the drawing).

The dimensions of the described device and its components, mounted on the corresponding railway transport facilities, are designed to comply with the interior of various railway constructions, their clearances and limits (or with other outlines, depending on the transport vehicles being used), said clearances and limits comprising only those components of the overall device which are designed for direct interaction with the rolling stock.

Accordingly, the positioning of all the components located within said inner space, defined by the overall dimensions, is correlated with the position of rolling stock components to be interacted with, thus eliminating any possibility to come into contact with other elements of the rolling stock.

These criteria hold for any other embodiment of the device.

The vertical movement of the carriage unit and the position of the bearing elements thereof, located between the head and base of the running rail, are capable to provide the shortest loop for the most powerful driving force flux, i.e. along the following route: the inner circular wheel rim surface—the rolling circle of the wheel—the upper face of the rail head—the lower face of the rail head—the bearing elements of the carriage—the pressure element.

Most of the above-mentioned elements, participating in the transfer of said driving force flux work in compression. Thus, the whole configuration of the device ensures a substantial reduction of the material consumption for the device and enhances its operational realiability.

The described method is accomplished by the operation of the devices, designed to fulfill it, and realization of this method will be better understood from an example, illustrating said method.

The operation of the device is accomplished in the following manner.

When the device is approached by the first wheel pair, a control signal from the sensor 26, indicating the position of the wheel 2, is delivered to the pumping plant 25, which gives rise to the pressure, via one of the hoses 24, in the chamber of the hydraulic cylinder 21. Under said pressure the rod 22 turns about the axle 15, the arm 16 from its idle position (FIG. 3) to the operational position (FIG. 4).

Accordingly, the pressure element 1 enters the cavity 3, formed by the inner circular surface 6, in the rim 18 of the wheel 2, and by the hub 5 and disk 4.

The sensor 26 and the control system of the hump, depending on the speed of the wheel pair and also on the speed of the railway transport vehicle, said speed being preset for the track section in question, would ensure the introduction of pressure element 1 into the cavity 3. When it becomes necessary to increase the speed of said train set (i.e. to accelerate the motion of the set), the pressure element 1 will occupy the front (relative to the wagon's motion) semicircle of the wheel. At decreasing the speed of the wagon (i.e. decelerating its motion) the pressure element 1 moves into the rear (relative to the wagon's motion) semicircle of the wheel.

When the speed of the train set corresponds to the speed chosen for a certain track section, the control system of the hump will send no command signal and, accordingly, the wagon will move freely over the speed control device without any interaction with said system.

If a wagon moves slower than desired over a certain point on the track, the control system of the hump will immediately react and send the corresponding command signal to the appropriate chamber of the hydraulic cylinder 30, and the fluid will start moving to said cylinder from the pumping plant 25 via the hose 35, and as a result, the rod 29 will push the frame 10 and the pressure element connected thereto, in the direction of the wagon's motion. The speed of the frame 10 being pushed, is set, insofar, by the pumping plant and will correspond to the optimal value, required at this point of the hump.

In addition, the pressure element, while moving within the cavity 3, catches up with the front semicircle of the inner circular wheel rim surface and starts pressing on the surface 6 of the region 7, with the preset force, and, as a result, the wheel 2, together with the whole wagon, is speeded up until its speed would reach the predetermined value, or else the frame 10 would come to its extreme position, determined by the length of the travel to be effected by the rod 29.

When the wagon moves faster than the carriage element, the rear face of the inner surface 6, in the rim of the wheel will roll on the pressure element and will start pressing it, thus releasing, at the moment, a certain part of the energy stored by the train set. In the course of mutual movement said wagon will speed its energy and its speed will be lowered up to the moment at which the speed of the wagon becomes equal to the speed of the carriage unit, as set by the drive unit.

After that, from the control system at the shunting yard, a command signal is fed to the pumping plant 25. Said signal received, the pressure in one of the chambers of the cylinder 21 will be reduced, while in the other chamber of said cylinder the pressure will rise to turn the arm 16, by the rod 22 and about the axle 16, to place said arm in its initial state (FIG. 3), releasing thereby the pressure element 1 from its engagement with the inner surface 6, formed in the rim of the wheel 2. The same will take place when the frame 10 gets to its limit position, even if the speed of the above-mentioned train set does not reach the predetermined value.

Then the wheel of the wagon will go on rolling with an increased (or reduced), by a certain value, speed. The aforesaid control system will provide regulation pressure in the chamber of the hydraulic cylinder 30, and as a result, the frame 10 will return to its initial state, thereby the device will get ready for interaction with the next wheel pair.

If the device includes two pressure elements the operation will be similar, differing only in that said interaction will occur between both wheels of the wheel pair and two rollers. Accordingly, the value of permissible force interaction may be doubled, proceeding from the approved specific pressure values, to be used at the points of contact.

Thus, the efficiency of the controlling interaction can be increased twice, with all the subsequent results thereof.

The use of a hydraulic drive, which is practically unlimited in the sense of ultimately permissible values, will allow the use of control characteristics approaching the optimal parameters, thereby ensuring high operational precision and efficiency of the device, when used with electronic control systems employed in shunting yards.

The described method would also enable to develop many other useful devices for the railway transport vehicles (wagon detainers, fixers, pushers, etc.).

The proposed method and device, therefore, will provide means for more intensified handling of railway transport facilities, without hazads to operational safety. This will make possible a considerable reduction in the amount of equipment used in control operation, which, in turn, will cut specific consumption of materials, to be used for mechanization of shunting yards, as well as labor costs and total production costs of the equipment.

The method and device proposed herein can be used in the operational process of humps and shunting yards for supervision of the speeds of wagons, small-size cars, as well as in those cases when it is necessary in accordance with the operational process to vary the motion speed of non-drive railway transport vehicles: slow them down, accelerate, bring to a stop, and set in motion.

What is claimed is:

1. A device for speed control of railway transport facilities, comprising at least one pressure element to provide force interaction with a wheel having a rim, in an area of mechanical trajectory of movement of said wheel, which element is mounted on a carriage connected with a drive unit, said carriage being able to move along a track, and a means to control the position of said pressure element, the pressure element being mounted on the carriage, said pressure element being adapted to be introduced into an annular space cavity of the wheel formed by a wheel disk, a wheel hub and an inner circular surface in the rim of the wheel, said pressure element having a shape chosen to provide entrance of said pressure element into said cavity and to ensure mating of said pressure element with the inner circular surface in the rim of the wheel, at any point within two regions located at both sides of an imaginary plane passing through an axle of the wheel and through a point of the wheel's contact with a rail.

2. A device according to claim 1, wherein the length of each of the regions of the inner circular surface in the rim of the wheel corresponds to the length of an arc, defined by rays drawn from a centre of the wheel and spaced apart from a point of the wheel contacting the rail, through an angle of 2° and 145°.

3. A device according to claim 2, wherein the length of each of the regions of the inner circular surface in the rim of the wheel corresponds to the length of an arc, defined by rays drawn from the centre of the wheel and spaced apart from the point of the wheel's contact with the rail through an angle of 2°–90°.

4. A device according to claim 1, wherein bearing elements of the carriage are accommodated between a head and a base of a running rail and are adapted to have a force contact both with a rail head and with a rail base.

5. A device according to claim 4, wherein the carriage is adapted to be movable in a vertical direction.

* * * * *